United States Patent [19]

Datta

[11] Patent Number: 4,560,601

[45] Date of Patent: Dec. 24, 1985

[54] HIGH-DENSITY INFORMATION DISC LUBRICANTS

[75] Inventor: Pabitra Datta, West Windsor Township, Mercer County, N.J.

[73] Assignee: RCA Corporation, Princeton, N.J.

[21] Appl. No.: 636,310

[22] Filed: Jul. 31, 1984

[51] Int. Cl.[4] ..... G11B 3/70; B32B 3/02

[52] U.S. Cl. ..... 428/64; 428/65; 428/447; 428/451; 252/49.6; 369/276; 369/288

[58] Field of Search ..... 428/64, 65, 447, 451; 252/49.6; 369/276, 288

[56] References Cited

U.S. PATENT DOCUMENTS

| | | | |
|---|---|---|---|
| 4,275,101 | 6/1981 | Wang et al. | 369/286 |
| 4,327,048 | 4/1982 | Nyman et al. | 264/107 |
| 4,327,140 | 4/1982 | Preston | 428/65 |
| 4,330,583 | 5/1982 | Datta et al. | 428/65 |
| 4,340,629 | 7/1982 | Hillenbrand et al. | 428/64 |
| 4,342,660 | 8/1982 | Berry et al. | 428/65 X |
| 4,346,468 | 8/1982 | Preston et al. | 369/276 |
| 4,346,469 | 8/1982 | Hillenbrand et al. | 369/276 |
| 4,355,062 | 10/1982 | Wang et al. | 428/64 |
| 4,389,441 | 6/1983 | Datta et al. | 428/64 X |
| 4,390,579 | 6/1983 | Datta et al. | 428/65 |
| 4,391,720 | 7/1983 | Wang et al. | 252/49.6 |
| 4,410,748 | 10/1983 | Datta et al. | 585/4 |
| 4,414,660 | 11/1983 | Wang et al. | 428/64 X |
| 4,416,789 | 11/1983 | Shidlovsky et al. | 428/447 X |
| 4,444,820 | 4/1984 | Datta et al. | 428/64 |
| 4,455,335 | 6/1984 | Datta et al. | 428/64 |
| 4,486,325 | 12/1984 | Poliniak | 428/64 X |

OTHER PUBLICATIONS

Foster, R., "Organic Charge-Transfer Complexes," Academic Press, New York (1969), pp. 2-12, 296-297.

*Primary Examiner*—Alexander S. Thomas
*Attorney, Agent, or Firm*—B. E. Morris

[57] ABSTRACT

High-density information records are lubricated with a methyl alkyl siloxane lubricant containing an effective amount of a donor-acceptor complex to reduce moisture sensitivity.

5 Claims, No Drawings

HIGH-DENSITY INFORMATION DISC LUBRICANTS

This invention relates to improved additives for high-density information disc lubricants. More particularly this invention relates to lubricant mixtures that contain additives that reduce the moisture sensitivity of capacitance electronic discs.

BACKGROUND OF THE INVENTION

During playback of high-density information discs, particularly capacitance electronic discs, a lubricant coating is present on the disc surface to reduce friction between the disc and the playback stylus. A suitable lubricant is a fractionated methyl alkyl siloxane having the formula

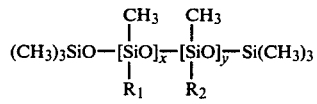

wherein $R_1$ and $R_2$ are alkyl groups of 4–20 carbon atoms, x is an integer of 2–4, y is an integer of 0–2 and wherein the sum of x and y is 4 or less, as disclosed by Wang et al. in U.S. Pat. No. 4,275,101 herein incorporated by reference. Because the discs contain a plurality of components such as stabilizers, flow modifiers and internal lubricants in addition to the plastic matrix and conductive filler, the surface of the disc is sensitive to moisture. When moisture condenses on the surface, it dissolves additives and salts formed during pressing that are at or near the disc's surface. When the water evaporates, a salt deposit is left behind that interferes with playback causing dropouts of information, for example. This phenomenon has been called "carrier distress". The same phenomenon also can result in short skips during playback caused by these deposits lifting the stylus away from the surface of the disc along one information track and dropping the stylus down in a different information track.

The addition of polar additives to reduce the carrier distress and short skips is known. The addition of polar groups to the non-polar lubricant reduces the interfacial energy between the lubricant and the disc surface and lessens the incidence of displacement of the lubricant by moisture at the surface. Many of these known additives, while effective, are either expensive, require expensive purification procedures or are incompatible with the lubricant and tend to separate out with time. Further, in order to ensure trouble-free playback they must be used with discs that have been treated by washing to remove moisture-soluble salts from the surface of the disc after pressing, whereas if they could be used with the disc directly as pressed from the mold, at least one step in manufacturing would be eliminated.

SUMMARY OF THE INVENTION

I have found a new class of lubricant additives, certain donor-acceptor complexes, that are effective additives to methyl alkyl siloxane lubricants and that reduce moisture sensitivity of high-density information records. These donor-acceptor complexes are derived from polyphenylene ether as donor and known acceptors.

DETAILED DESCRIPTION OF THE INVENTION

The donor-acceptor complexes useful in the present invention comprise polyphenylene ether as donor and suitable acceptors including aliphatic and aromatic systems that contain strong electron-withdrawing substituents, such as nitro-, cyano-, halo-, and also include acid anhydrides and quinones. Suitable acceptors are well known and include 2,4,7-trinitrofluorenone, 2,4,5,7-tetranitrofluorenone and halo-substituted nitrofluorenones; pyromellitic dianhydride; halo- or cyano-substituted benzoquinones; cyano-substituted quinodimethanes; cyano-, halo-, methyl-, or nitro-substituted ethylene; methal salts of the above, and the like. Additional acceptors are well known to those skilled in the art.

The complexes are made by dissolving the donor polymer and acceptor in a suitable, solvent, such as propylene carbonate, and then evaporating the solvent.

The additive complex is then added to a lubricant such as methyl alkyl siloxane or polyphenylene ether lubricants. The complex can be added in amounts generally of from about 1 to about 25 percent by weight, preferably about 10 to 20 percent by weight, but this is not critical and higher amounts can be employed. The lubricant can be applied to the surface of the disc from a solvent mixture, for example a heptane-isopropanol mixture in which the components are soluble, either by spraying or by immersing the records in the solution. Alternatively the dopant can be applied directly to the surface of the disc by means of a very fine nozzle.

The lubricated discs have improved resistance to the effect of elevated temperatures and moisture and the lubrication is sufficient to prevent undue stylus wear of the records during playback. The lubricant system of the present invention can be applied to high-density information records as they are pressed from the mold, which is preferable, although they can be treated first with an aqueous solution and then dried with a solvent such as 1,1,2-trifluoro-2,2,1-trichloroethane.

The invention will be further illustrated by the following Examples, but the invention is not meant to be limited to the details described therein. In the Examples parts and percentages are by weight unless otherwise noted.

Carrier distress time is measured by adding the amount of time in seconds (but discounting intervals of less than 10 microseconds) during record playback when the r.f. output of the player arm is less than 150 millivolts peak to peak and the time when the r.f. output gives above 8.6 or below 3.1 megahertz in frequency, indicating a defect. Such defects are noted by the viewer as dropouts. The present acceptable level of carrier distress for a video record is three seconds in one hour of playback time.

Another test of the disc is known as the small skips test. The r.f. output of the player arm normally detects eight consecutively numbered daxi codes for each rotation of the disc. Thus if less than eight daxi codes are noted per rotation, a computer attached to the player determines the number of daxi codes missed and then computes the number of grooves skipped. The number of times during one hour of playback that eight grooves or less are skipped (one small skip event) is monitored. The present acceptable level of small skip events is 30 per one hour of playback.

EXAMPLES 1-5

Five parts of polyphenylene ether, a 5-ring polyphenyl ether from W. F. Nye Inc. available as No. 438, and 5.5 parts of the lithium salt of 7,7,8,8-tetracyanoquinone dimethane were dissolved in 100 parts by volume of propylene carbonate for one hour. The solvent was then removed in a rotary evaporator.

A 0.3 percent solution of methyl decyl siloxane in 80:20 heptane-isopropanol mixed solvent was prepared and 0.045 percent of the donor-acceptor complex prepared as above was added. Capacitance electronic discs as pressed were spray-coated with the doped lubricant and played back. The discs were then exposed in a chamber maintained at 100° F. and 95 percent relative humidity for one hour and replayed.

The above procedure was repeated for several other donor-acceptor complexes and compared to several controls. Control A is a standard doped lubricant containing methyl decyl siloxane and 10 percent of

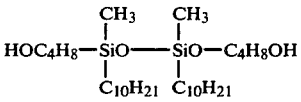

and was applied to discs washed after pressing according to U.S. Pat. No. 4,327,048. Control B samples were sprayed with the standard doped lubricant as above on discs as pressed. Control C was undoped methyl decyl siloxane lubricant on as-pressed discs.

The complexes of Examples 2-5 were prepared by dissolving 5 grams of polyphenylene ether as above in 100 parts by volume of propylene carbonate and adding the following:

| Example | Acceptor | Amount, Parts |
|---|---|---|
| 2 | tetracyanoethylene | 3.25 |
| 3 | 7,7,8,8,-tetracyanoquinodimethane | 5.5 |
| 4 | 2,4,7-trinitro-9-fluorenone | 7 |
| 5 | 2,6-dinitro-9-fluorenone | 7 |

The results obtained for carrier distress and short skip testing are summarized in the Tables below.

TABLE I

| | Carrier Distress, secs./hour of play | | | | | |
|---|---|---|---|---|---|---|
| | Initial Play | | | After Stressing | | |
| Sample | Median | Range | # Pass | Median | Range | # Pass |
| Control A | 0.2 | 0.1-0.6 | 12/12 | 0.3 | 0.2-1.6 | 12/12 |
| Control B | 0.4 | 0.18-5.0 | 11/12 | 3.3 | 0.9-300 | 6/12 |
| Control C | 0.5 | 0.2-1.5 | 12/12 | 3.7 | 2-450 | 3/12 |
| Example 1 | 0.2 | 0.1-0.8 | 12/12 | 0.3 | 0.1-2.1 | 12/12 |
| Example 2 | 0.3 | 0.1-1.2 | 12/12 | 0.45 | 0.1-1.7 | 12/12 |
| Example 3 | 0.3 | 0.1-2.1 | 12/12 | 0.4 | 0.1-1.5 | 12/12 |
| Example 4 | 0.4 | 0.1-1.9 | 12/12 | 0.5 | 0.1-4.5 | 10/12 |
| Example 5 | 0.2 | 0.1-1.7 | 12/12 | 0.3 | 0.1-3.5 | 11/12 |

TABLE II

| | Short Skips, secs./hour of play | | | | | |
|---|---|---|---|---|---|---|
| | Initial Play | | | After Stressing | | |
| Sample | Median | Range | # Pass | Median | Range | # Pass |
| Control A | 4 | 0-46 | | 16 | 0-278 | 10/12 |
| Control B | 6 | 0-70 | | 26 | 0-290 | 3/12 |
| Control C | 4 | 0-36 | | 30 | 0-250 | 10/12 |
| Example 1 | 4 | 0-30 | | 8 | 0-90 | 9/12 |
| Example 2 | 6 | 0-20 | | 6 | 0-150 | 10/12 |
| Example 3 | 4 | 0-78 | | 16 | 0-450 | 7/12 |
| Example 4 | 8 | 0-74 | | 14 | 0-300 | 9/12 |
| Example 5 | 6 | 0-50 | | 12 | 0-240 | 6/12 |

It is apparent that the present lubricant additives impart good moisture sensitivity to the surface of capacitance electronic discs and the discs do not require a separate treatment step.

I claim:

1. In a capacitance electronic disc having a lubricant film thereon, the improvement which comprises adding to the lubricant an effective amount of a donor-acceptor complex wherein the donor is polyphenylene ether to reduce moisture sensitivity.

2. A disc according to claim 1 wherein the lubricant is a methyl alkyl siloxane.

3. A disc according to claim 2 wherein the donor is polyphenylene ether.

4. A disc in accordance with claim 2 wherein the acceptor is selected from the group consisting of 7,7,8,8-tetracyanoquinodimethane, the lithium salt of 7,7,8,8-tetracyanoquinodimethane, tetracyanoethylene, 2,4,7-trinitro-9-fluorenone, and 2,6-dinitro-9-fluorenone.

5. A disc in accordance with claim 1 wherein the acceptor is selected from the group consisting of 7,7,8,8-tetracyanoquinodimethane, the lithium salt of 7,7,8,8-tetracyanoquinodimethane, tetracyanoethylene, 2,4,7-trinitro-9-fluorenone, and 2,6-dinitro-9-fluorenone.

* * * * *